United States Patent [19]

Bounds

[11] Patent Number: 4,543,083

[45] Date of Patent: Sep. 24, 1985

[54] CENTRIFUGE AND VALVE THEREFOR

[75] Inventor: Jerry O. Bounds, Dowagiac, Mich.

[73] Assignee: Crude Oil Quality Control Corporation of Michigan, Dowagiac, Mich.

[21] Appl. No.: 617,775

[22] Filed: Jun. 6, 1984

[51] Int. Cl.[4] ..... B04B 1/16

[52] U.S. Cl. ..... 494/4; 210/145; 251/61.4; 494/56

[58] Field of Search ..... 494/2, 4, 3, 5, 56, 494/40, 6, 27; 251/61.4, 12, 14, 28; 210/145; 55/160

[56] References Cited

U.S. PATENT DOCUMENTS

| | | | |
|---|---|---|---|
| 3,408,000 | 10/1968 | Nilson | 494/3 |
| 3,749,303 | 7/1973 | Hemfort | 494/2 |
| 3,990,632 | 11/1976 | Hemfort | 494/2 |
| 4,149,668 | 4/1979 | Zurbruggen | 494/2 |
| 4,356,837 | 11/1982 | Dickinson | 251/61.4 |

*Primary Examiner*—Robert W. Jenkins

*Attorney, Agent, or Firm*—Flynn, Thiel, Boutell & Tanis

[57] ABSTRACT

A centrifuge for separating first and second liquids having different specific gravities includes a container supported for rotation about an axis, a drive arrangement for rotating the container, a supply arrangement for introducing a mixture of the liquids into the container, a valve arrangement supported on the container and in fluid communication with and responsive to fluid pressure in a radially outermost portion of the container for discharging quantities of the first liquid from such portion of the container to the region external to the container during rotation of the container, and an arrangement for removing from the container during rotation thereof quantities of the second liquid. A valve of the valve arrangement includes a housing having a cylindrical bore which opens into a chamber, a flexible diaphragm extending across the chamber perpendicular to the bore, an elongate tube slidably supported in the bore and being sealingly received in a central opening in the diaphragm, a resilient arrangement yieldably urging axial movement of the tube, a passageway in the valve housing providing fluid communication between opposite sides of the container wall, and a valve member fixedly supported on the tube and movable between positions obstructing and permitting fluid flow through the passageway.

24 Claims, 4 Drawing Figures

CENTRIFUGE AND VALVE THEREFOR

FIELD OF THE INVENTION

This invention relates to a centrifuge and a valve therefor and, more particularly, to a centrifuge and valve which are adapted to separate water from crude oil.

BACKGROUND OF THE INVENTION

A significant portion of the crude oil purchased by refineries is obtained from relatively small, low volume wells. Wells of this type have an output of less than 100 gallons per hour, and typically have an output in the range of 15 to 25 gallons per hour.

The oil from the well is usually supplied to a device which is commonly called a "heater treater". The heater treater is a baffled vessel which has a quantity of hot water at the bottom and pressurized gas thereabove, and the crude oil is introduced into the water at the bottom of the heater treater. A layer of floating oil will slowly build up on the surface of the water and, when a predetermined quantity of oil has built up, the increased fluid pressure will activate a valve which discharges some of the oil from the heater treater, typically about 6 to 8 gallons. A discharge of this type will usually occur every 5 to 25 minutes, depending on the volume of the associated well.

The oil discharged from the heater treater contains a residual quantity of water which is normally about three percent but, depending on the particular well, can be as high as eight percent or nine percent. This amount of water presents a serious problem, because a refinery will typically not purchase oil having a water content greater than a specified percentage, which is usually about one-half of one percent. It is thus important to remove as much water as possible from the oil in order to ensure that the oil will be readily marketable.

The specific gravity of crude oil is typically less than 1.0, and a traditional approach to separating two fluids having different specific gravities is to place a receptacle containing a mixture of the fluids into a centrifuge, thereafter turn on the centrifuge and rotate the receptacle at a high rate of speed in order to effect a separation of the fluids through centrifugal force, then stop the centrifuge and remove the receptacle, and then remove one of the separated liquids from the receptacle utilizing a further apparatus. A centrifuge of this type is, however, impractical for use in association with a small oil well, because it does not operate continuously, but rather in discrete separating cycles, and because either manual operation or an expensive control apparatus is required in order to effect the cyclic loading, actuation, deactuation and unloading of the centrifuge.

It is therefore an object of the invention to provide an improved centrifuge which can efficiently separate water from crude oil, and which is capable of continuous and unattended operation for long periods of time.

A further object of the invention is to provide a centrifuge, as aforesaid, which is structurally simple, relatively compact, and relatively inexpensive to manufacture and operate, so that it will be economically feasible to utilize it in conjunction with an oil well of relatively low volume.

A further object of the invention is to provide a centrifuge, as aforesaid, which is rugged and dependable and requires minimal maintenance.

SUMMARY OF THE INVENTION

The objects and purposes of the invention, including those set forth above, are met by providing a centrifuge which includes a container supported for rotation about an axis, a drive arrangement for effecting rotation of the container, a supply arrangement for introducing into the container during rotation thereof a mixture of first and second liquids, a valve arrangement which is supported on the container and is responsive to fluid pressure in the container for discharging quantities of the first liquid from a radially outermost portion of the container to a location external to the container during rotation of the container, and an arrangement for removing from the container during rotation thereof quantities of the second liquid which have been separated from the first liquid.

In a preferred embodiment of the inventive centrifuge, the container is a cylindrical drum which rotates about a vertical axis and has a baffle arrangement therein. The baffle arrangement includes annular, vertically spaced first baffle plates which are provided on and extend radially inwardly from a sidewall of the container, an annular second baffle plate supported a small distance above and approximately parallel to a bottom wall of the container, and an annular third baffle plate supported a small distance above the lowermost of the first baffle plates, the third baffle plate having a radially outer edge which is spaced radially inwardly from the cylindrical wall of the container and radially outwardly of the radially inner edge of the first baffle plate immediately thereabove, and the third baffle plate having a radially inner edge which is spaced radially inwardly from the radially inner edge of the first baffle plate immediately below it.

The valve arrangement in the preferred embodiment of the centrifuge includes a valve having a housing adapted to be fixedly supported on a wall of the container so that a portion thereof extends through an opening in the wall of the container, the valve housing having a bore extending through such portion and opening at its radially outer end into a chamber provided in the vale housing. A flexible diaphragm extends across the chamber approximately perpendicular to the bore and has its peripheral edges sealingly supported by the valve housing, and an elongate tube is slidably supported in the bore and has one end sealingly received in a central opening in the diaphragm and held against movement relative to the diaphragm. A resilient arrangement urges axial movement of the tube, a passageway in the valve housing provides fluid communication between locations inside and outside the container, and a valve member is fixedly supported on the tube, movement of the tube causing the valve member to move between positions in which it respectively permits and obstructs fluid flow through the passageway.

BRIEF DESCRIPTION OF THE DRAWINGS

A preferred embodiment of the inventive centrifuge and a valve therefor is described in detail hereinafter in association with the accompanying drawings, in which.

DETAILED DESCRIPTION

Figure 1:
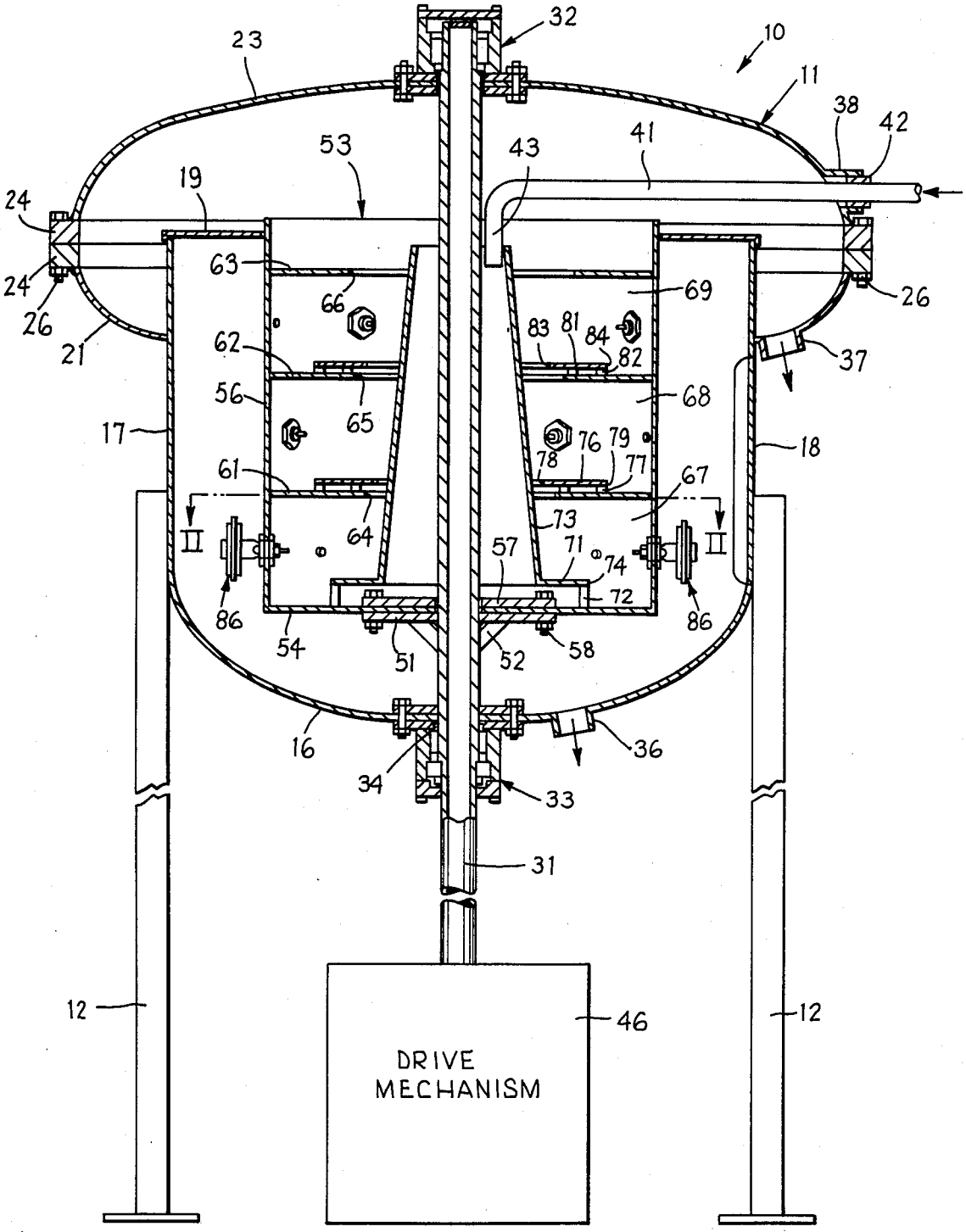
FIG. 1 is a sectional side view of a centrifuge embodying the present invention.

A centrifuge embodying the present invention is designated by reference numeral 10 in FIG. 1, and includes a closed housing 11 and a plurality of vertically extending legs 12 which are welded to and support the housing 11.

The housing 11 is preferably designed to hold an internal pressure of up to 55 psi. The housing 11 includes a bottom wall 16 which is bent to have a concave upper surface, and includes a cylindrical sidewall 17 which extends vertically upwardly from the peripheral edges of the bottom wall 16. The cylindrical sidewall 17 preferably has a portion 18 on one side thereof which serves as a removable access panel and is normally removably secured in the illustrated position by a conventional and not-illustrated fastener arrangement. A platelike annular cap 19 is supported on and extends radially inwardly from the upper edge of the cylindrical sidewall 17.

The housing 11 further includes a curved, annular catch tray 21 which is welded to the exterior surface of the cylindrical sidewall 17 at a location spaced below the upper end thereof, extends upwardly and outwardly from the cylindrical sidewall 17 and has an annular flange 22 secured to its upper edge. A top wall or cover 23 of the housing 11 is bent to have a concave undersurface, and an annular flange 24 is secured to the peripheral edges of the top wall 23 and rests on the annular flange 22. The flanges 22 and 24 are secured to each other by a plurality of angularly spaced bolts and nuts 26 disposed in aligned vertical openings in the flanges 22 and 24. If necessary, an annular gasket can be provided between the flanges 22 and 24 in order to ensure a proper seal therebetween. Further, an access panel similar to the access panel 18 could, if desired, be provided in the top wall 23.

A vertical shaft 31 extends with a small clearance through openings provided in the top wall 23 and bottom wall 16 of the housing 11, and is supported for rotation by conventional bearing assemblies 32 and 33 which are respectively bolted to the top wall 23 and bottom wall 16. The bearing assemblies 32 and 33 are conventional and commercially available devices, and are thus not described in detail. Each includes an annular seal element which sealingly engages the shaft 31, as at 34, which minimizes the leakage of fluids and gases from the housing 10 and thus minimizes the likelihood of an explosion caused by flammable gases coming into contact with an overheated bearing.

The bottom wall 16 of the housing 11 has an outlet port 36 therethrough near the bearing assembly 33, the catch tray wall 21 has an outlet port 37 therethrough adjacent the cylindrical sidewall 17, and the top wall 23 has an inlet port 38 therethrough adjacent its annular flange 24. A supply pipe 41 extends horizontally through the inlet port 38, is sealingly secured therein by an annular seal 42, and has a downwardly bent end portion 43 adjacent the vertical shaft 31. A conventional drive mechanism 46 is operatively coupled to the lower end of the vertical shaft 31 and can effect rotation of the shaft 31 at a constant, predetermined speed, which in the preferred embodiment is 350 rpm.

A horizontal plate 51 is fixedly secured to the shaft 31, for example by welding, and several angularly spaced braces 52 are welded to the plate 51 and shaft 31 in order to ensure a rigid connection between the plate 51 and shaft 31. A cylindrical drum or container 53 has a horizontal bottom wall 54 which rests on the plate 51 and has a central opening through which the shaft 31 extends, and the container 51 has a cylindrical sidewall 56 which extends upwardly from the peripheral edges of the bottom wall 54 substantially coaxial with the shaft 31, the inner edge of the cap 19 being spaced a small distance radially from the upper edge portion of the sidewall 56. An annular plate 57 is provided on the upper side of the bottom wall 57, and the bottom wall 54 of the container 53 is securely clamped between the plates 51 and 57 by a plurality of angularly spaced bolts and nuts 58 which are received in aligned openings in the plate 51, bottom wall 54 and plate 57.

The container 53 includes three annular main baffle plates 61, 62 and 63 which are secured to and extend radially inwardly from the cylindrical sidewall 56 at vertically spaced locations thereon, the radially inner edge 65 of the baffle plate 62 being located radially outwardly of the inner edge 64 of the baffle plate 61 and radially inwardly of the inner edge 66 of the baffle plate 63. The main baffle plates 61, 62 and 63 effectively define three annular, vertically spaced compartments 67, 68 and 69 adjacent the cylindrical sidewall 56 of the container 53.

An annular auxiliary baffle plate 71 is fixedly supported a small distance above the bottom wall 54 of the container 53 by a plurality of angularly spaced supports 72. The radially outer edge 74 of the auxiliary baffle plate 71 is located radially outwardly of the inner edge 64 of the lowermost main baffle plate 61. A frustoconical wall 73 is provided on and converges upwardly from the radially inner edge of the auxiliary baffle plate 71, the upper end of the frustoconical wall 73 being spaced slightly below the upper edge of the cylindrical sidewall 56 of the container 53, and the end portion 43 of the supply pipe 41 extending a small distance into the upper end of the frustoconical wall 73.

The main baffle plate 61 has an annular auxiliary baffle plate 76 fixedly supported a small distance thereabove by a plurality of angularly spaced supports 77, the radially inner edge 78 of the baffle plate 76 being located radially inwardly of the radially inner edge 64 of the main baffle plate 61, and the radially outer edge 79 of the baffle plate 76 being located radially outwardly of the radially inner edge 64 of the main baffle plate 61. Similarly, the main baffle plate 62 has an annular auxiliary baffle plate 81 supported thereabove by a plurality of angularly spaced supports 82, the inner edge 83 of the baffle plate 81 being spaced radially inwardly from the inner edge 65 of the baffle plate 62, and the radially outer edge 84 of the baffle plate 81 being located radially outwardly of the inner edge 65 of the baffle plate 62.

Figure 2:
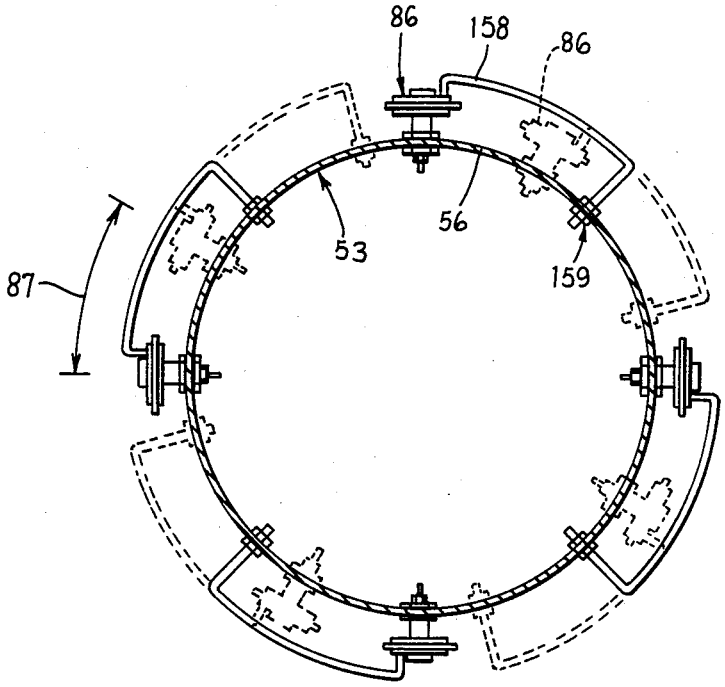
FIG. 2 is a fragmentary sectional view taken along the line II—II in FIG. 1.

As shown in FIGS. 1 and 2, four angularly spaced valve 86 are mounted in the cylindrical sidewall 56 of the container 53 at the level of the compartment 67. Similarly, four angularly spaced valves 86 are mounted in the cylindrical sidewall 56 at the level of the compartment 68, and four angularly spaced valves 86 are provided at the level of the compartment 69. The valves at the level of the compartment 68 are shown in broken lines in FIG. 2 and are preferably offset angularly by 30° from the valves therebelow, as shown at 87 in FIG. 2. Similarly, the valves at the level of the compartment 69 are preferably offset angularly by 30° from the valves at the level of the compartment 68.

Figure 3:
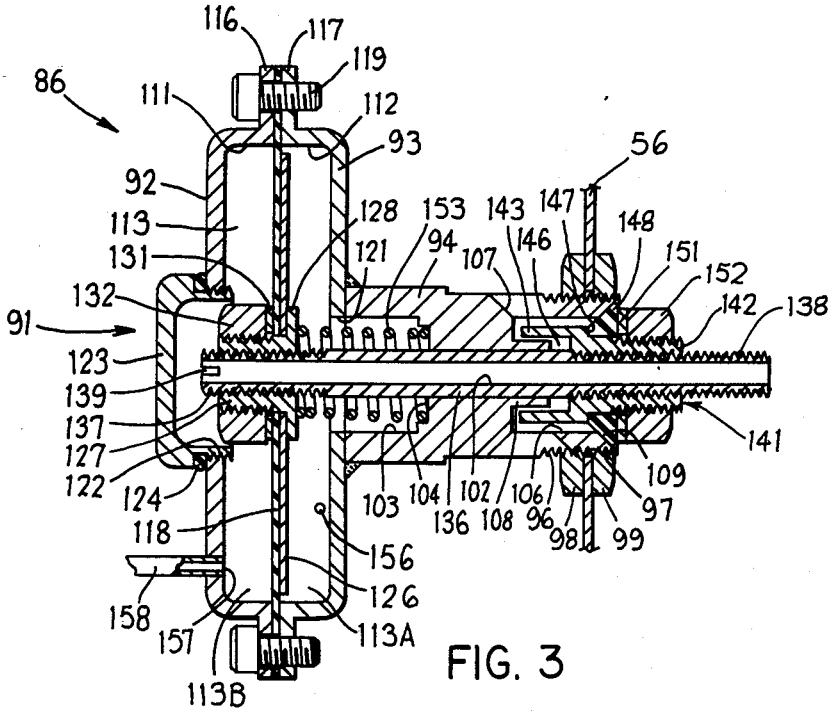
FIG. 3 is a sectional side view of a valve which is a component of the centrifuge of FIG. 1.

The valves 86 are all identical, and therefore only one valve 86 is described in detail. Referring to FIG. 3, each valve 86 has a valve housing 91 which includes two circular members 92 and 93 which are bent metal plates, and a cylindrical stem 94 is welded to and projects outwardly from the circular member 93 coaxial therewith. The stem 94 is externally threaded at the end 96 thereof remote from the circular member 93. The threaded end 96 of the stem 94 extends through an opening 97 provided in the cylindrical wall 56 of the container 53 and has two nuts 98 and 99 thereon which are screwed up tightly against opposite sides of the wall 56 in order to fixedly and sealingly support the stem 94 in the wall 56 of the container 53.

The stem 94 has an axial bore therethrough which includes a central portion 102, an end portion 103 of larger diameter adjacent the circular member 93 and defining an axially facing shoulder 104, and an end portion 106 of larger diameter at the end remote from the circular member 93. Four angularly spaced, transversely extending, frustoconical discharge openings are provided in the stem 94 adjacent the threaded end portion 96, and each communicate with the axially inner end of the end portion 106 of the bore. An annular flange 108 projects axially a short distance into the end portion 106 of the bore, and has an inside diameter substantially equal to that of the bore central portion 102 of the bore. An annular, frustoconical valve seat 109 is provided at the end of the stem 94 remote from the circular member 93, and converges in a direction toward the circular member 93.

The circular members 92 and 93 have aligned, shallow cylindrical recesses 111 and 112, respectively, which define a cylindrical chamber 113 within the valve housing 86. The circular members 92 and 93 have respective annular flanges 116 and 117 which are adjacent, and a flexible circular diaphragm 118 has its peripheral edges clamped between the flanges 116 and 117 by a plurality of angularly spaced screws 119 which each extend through aligned openings in the flange 116 and diaphragm 118 and engage a threaded opening provided in the flange 117. The diaphragm 118 divides the chamber 113 into two portions 113A and 113B.

The circular member 93 has an opening 121 therethrough which is aligned with and of substantially the same diameter as the end portion 103 of the bore through the stem 94, and the circular member 92 has a threaded opening 122 therethrough. A cap 123 is screwed into the threaded opening 122, and an annular seal 124 is clamped between the circular member 92 and a shoulder on the cap 123 in order to effect a fluid seal therebetween.

A circular diaphragm plate 126 is disposed against the diaphragm 118 on the side thereof nearest the stem 94, and the diaphragm plate 126 and diaphragm 118 have aligned central openings. The diaphragm 118 and diaphragm plate 126 are not directly connected to each other. A sleevelike fitting 127 which is internally and externally threaded extends through the openings in the diaphragm 118 and diaphragm plate 126, and has a radially outwardly extending flange 128 at one end which is disposed against the diaphragm plate 126. A washer 131 is provided around the fitting 127 adjacent the diaphragm 118, and a nut 132 is screwed onto the fitting 127 so that the nut 132 and flange 128 securely clamp the diaphragm 118 and diaphragm plate 126 together in the region adjacent the central openings therethrough.

An elongate tube 136 is slidably received in and has an outside diameter substantially equal to the central portion 102 of the bore through the stem 94. The ends 137 and 138 of the tube 136 are externally threaded, the end 137 being threadedly received in the central opening through the fitting 127 and having an axially extending slot 139. The threaded end 138 of the tube 136 projects past the valve seat 109 on the end of the stem 94.

A sleevelike fitting 141 has an internally and externally threaded portion 142 which is screwed onto the threaded end 138 of the tube 136, and has an annular flange 143 which projects axially toward the chamber 113 and is spaced radially from the tube 136 so as to define an annular recess 146. The flange 143 axially overlaps the flange 108 on the stem 94, the flange 108 extending into the annular recess 146. The sleevelike fitting 141 also has an annular shoulder 147 thereon facing axially away from the chamber 113. An annular seal element 148 made of a resilient material snugly encircles the end portion 142 of the fitting 141, is clamped between the shoulder 147 and a washer 151 and nut 152 provided on the end portion 142, and has a frustoconical seal surface which can sealingly engage the frustoconical valve seat 109 on the stem 94.

A helical compression spring 153 coaxially encircles the tube 136 within the chamber 113, one end of the spring being disposed against the flange 128 on the fitting 127 and the other end of the spring being disposed against the annular shoulder 104 in the bore through the stem 94. The spring 153 continuously urges leftward movement in FIG. 3 of the diaphragm 118 and the tube 136, which corresponds to movement of the seal element 148 into engagement with the valve seat 109 so as to obstruct fluid flow through the passageway in the stem 94 defined by the bore portion 106 and the discharge openings 107.

The circular member 93 has a small air vent hole 156 therethrough which provides communication between the chamber portion 113A and the air surrounding the valve 86. The circular member 92 has a fluid vent hole 157 which communicates with one end of a conduit 158. As shown in FIG. 2, the opposite end of the conduit 158 communicates with the interior of the container 53 through a fitting arrangement 159 which is provided in a small opening in the cylindrical sidewall 56 of the container 53 at a location spaced angularly by approximately 45° from the associated valve 86.

Each valve 86 is preferably made entirely of stainless steel, except for the diaphragm 118, seal element 124, and seal element 148, which are preferably made of urethane.

Due to the large surface area of diaphragm 118 presented to the chamber portion 113B, the valve 86 is highly sensitive to small fluid pressure changes. When the valve 86 opens, the space between the seal element 148 and valve seat 109 will typically be about 0.01".

OPERATION

Figure 4:
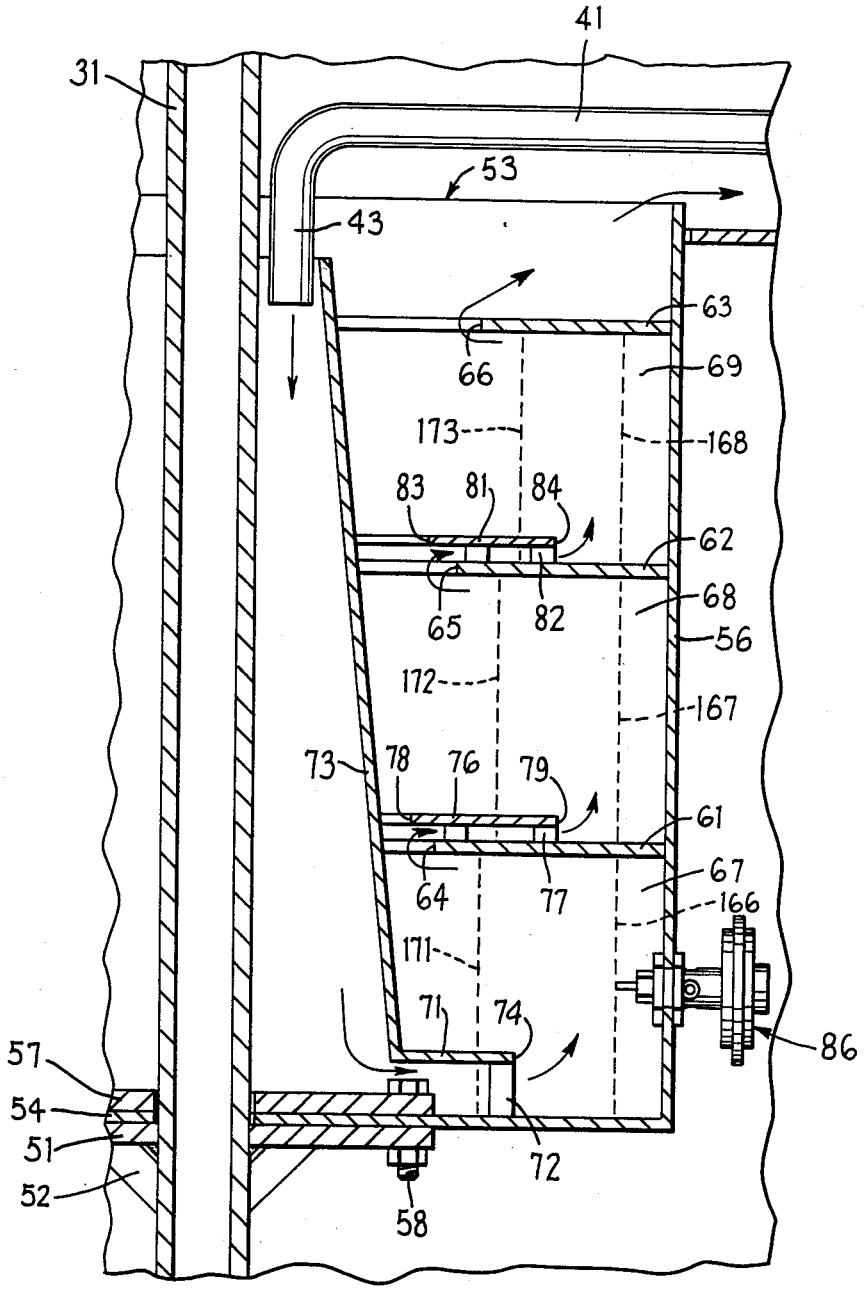
FIG. 4 is an enlarged view of a portion of FIG. 1.

During operation, the drive mechanism 46 will be continuously rotating the shaft 31 and thus the container 53 at a predetermined speed, and the compartments 67, 68 and 69 of the container 53 will each have an annular layer of water adjacent the cylindrical wall 56, as shown in broken lines in FIG. 4 at 166–168, and will have an annular layer of oil radially inwardly of the layer of water, as shown at 171–173 in FIG. 4. The centrifugal force exerted on the fluid in the container 53 is preferably about forty times the force of gravity.

Periodically, several gallons of crude oil will be introduced into the centrifuge 10 through the supply pipe 41, the end portion 43 of which is disposed within the upper portion of the frustoconical wall 73. This additional oil will drop to the bottom of the container 53 and then flow radially outwardly between the container bottom wall 54 and the auxiliary baffle 71, thereby increasing the total quantity of fluid in the compartment 67 and causing a portion of the oil layer 171 to flow over the radially inner edge of the main baffle 61, between the auxiliary baffle 76 and main baffle 61, and into the compartment 68. Due to the different specific gravities of the water and oil, centrifugal forces will tend to separate the water from the oil introduced into the compartment 67, the water moving from the oil layer 171 to the water layer 166. The action of centrifugal forces on the additional fluid introduced into the compartment 67 will also, through the tube 136 (FIG. 3) and conduit 158, effect an increase in the fluid pressure within the chamber 113B of the valve 86, thereby causing the diaphragm to move a small distance rightwardly against the force of the spring 153, which in turn causes the tube 136 to move rightwardly and the seal element 148 thereon to move a small distance away from the annular valve seat 109, so that water from the water layer 166 (FIG. 4) flows between the seal member 148 and valve seat 109, through the bore portion 106 and the discharge openings 107, and into the lower portion of the housing 11 (FIG. 1), where it flows downwardly to and is discharged through the outlet port 36. As water is discharged from the compartment 67, the fluid pressure in the portion 113B of the chamber 113 will gradually decrease until the spring 153 has moved the diaphragm 118, tube 136 and seal element 148 leftwardly so that the seal element 148 is again sealingly engaging the valve seat 109 and thus obstructing further water discharge.

The oil from the layer 171 in the compartment 67 which flows into the compartment 68 in the manner described above will have much, but not all, of the water removed therefrom. The flow of oil into and the discharge of water and oil from the compartment 68 is functionally similar to that described above for the compartment 67, and is therefore not described again in detail. Similarly, the flow of oil into and the discharge of water and oil from the compartment 69 is similar to that described for compartment 67.

The oil from the oil layer 173 in the compartment 69 which flows over the radially inner edge 66 of the main baffle 63 has a very low percentage of water. It is carried upwardly and outwardly by centrifugal force, over the upper edge of the sidewall 56 of the container 53 and out into the annular catch tray 2 (FIG. 1) of the housing 11, from which it is discharged through the outlet port 37. The cap 19 prevents this oil from dropping into the lower portion of the housing 11, where it would be discarded with the water being discharged through the port 36.

The force necessary to open each valve 86 is adjusted during initial set-up of the centrifuge 11 by removing the access panel 18 (FIG. 1) of the housing 11 and then removing the cap 123 (FIG. 3) on a valve 86 to be adjusted. A screwdriver or similar implement is then inserted into the slot 139 in the tube 136 and the tube 136 is rotated, which will adjust its axial position relative to the fitting 127 and the diaphragm 118, which in turn will adjust the separation produced between the valve seat 109 and the seal element 148 in response to a given fluid pressure within the portion 113B of the chamber 113. The valve has been designed so that centrifugal force assists movement of the seal element 148 into its closed position engaging the valve seat 109, thereby facilitating closing of the valve in response to a small pressure decrease and also minimizing the likelihood that small particles, such as dirt or carbon in the water being discharged, will interfere with proper closing of the valve. Further, the overlapping flanges 143 and 108 (FIG. 3) of the valve tend to channel water flowing through the valve out through the discharge openings 107, so that it does not flow axially along the tube 136 and into the portion 113A of the chamber 113.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A centrifuge for separating first and second liquids from a mixture thereof, the specific gravity of the first liquid being greater than that of the second liquid, comprising: a container supported for rotation about an axis; drive means for effecting rotation of said container about said axis; supply means for introducing into said container during rotation thereof the mixture of the first and second liquids, rotation of said container causing the first liquid to move to a radially outermost portion of said container; valve means supported on said container and in fluid communication with said portion of said container and with a region external to said container, said valve means being responsive to fluid pressure in said portion of said container for discharging quantities of the first liquid from said portion of said container to said region external to said container during rotation of said container; and means for removing from said container during rotation thereof quantities of the second liquid which have been separated from the first liquid; wherein said container includes a cylindrical wall substantially concentric with said axis, said portion of said container being adjacent said wall and said wall having plural angularly spaced openings therethrough; and wherein said valve means includes plural valves which are each supported on said cylindrical wall in the region of a respective said opening therein and which each control fluid flow through the associated opening.

2. The centrifuge according to claim 1, wherein each said valve includes: a housing which is fixedly supported on said cylindrical wall of said container and has a stem portion extending through a said opening in said cylindrical container wall, said valve housing having a bore therein which extends approximately radially of said axis of rotation and which opens at its radially outer end into a chamber provided in said valve housing, a flexible diaphragm extending across said chamber approximately perpendicular to said bore and having its peripheral edges sealingly supported by said valve housing; an elongate tube extending through a central opening in said diaphragm and being slidably received in said bore; means for sealingly coupling said diaphragm and said tube so that movement of said diaphragm effects axial movement of said tube; resilient means for yieldably urging axial movement of said tube in a direction away from said axis of rotation; means defining a passageway in said valve housing which provides fluid communication between locations inside and outside said container, said passageway having a radially inwardly facing valve seat at an end thereof which communicates with the interior of said container; and a valve member fixedly supported on said tube and movable in response to axial movement of said tube between open and closed positions in which said valve member is respectively spaced from and engaging said valve seat on said valve housing and respectively permits and obstructs fluid flow through said passageway in said valve housing.

3. The centrifuge according to claim 2, wherein said bore in said valve housing has an enlarged portion which extends from the radially inner end of said stem portion to a location spaced outwardly of said cylindrical wall of said container, and including a discharge opening in said stem portion of said valve housing which provides fluid communication between said enlarged portion of said bore and a location external to said valve housing and said container, said enlarged portion of said bore and said discharge opening serving as said passageway through said stem portion of said valve housing, and said valve seat and said valve member being annular and encircling said tube.

4. The centrifuge according to claim 3, wherein said valve housing includes an annular flange which extends into said enlarged portion of said bore adjacent and substantially parallel to said tube in a direction toward said axis of rotation; wherein said valve member includes a fitting which is supported on and fixed against axial movement with respect to said tube and has at the end thereof remote from said axis of rotation an annular recess which is adjacent said tube and into which said annular flange on said valve housing extends; wherein said valve seat on said valve housing is a frustoconical surface which converges in a direction away from said axis of rotation; and wherein said valve member is an annular seal element which is fixedly supported on said fitting and has a frustoconical surface engageable with said valve seat.

5. The centrifuge according to claim 4, wherein said valve housing has means defining a first vent opening which provides fluid communication between a location external to said valve housing and a portion of said chamber on a side of said diaphragm nearest said axis of rotation; and including means defining a vent line which provides fluid communication between a location within said container adjacent said cylindrical wall thereof and said chamber in said valve housing on a side of said diaphragm remote from said axis of rotation.

6. The centrifuge according to claim 5, including a plate which is disposed against said diaphragm on the side thereof facing said axis of rotation and which has a central opening aligned with said central opening in said diaphragm; wherein said means for sealingly coupling said tube and said diaphragm includes fitting means which extends through said aligned openings in and securely clamps together said diaphragm and said diaphragm plate, and which has an internally threaded central opening extending axially therethrough; and wherein said tube has an externally threaded portion which is received in said threaded opening through said fitting means, whereby rotation of said tube relative to said fitting means effects adjustment of the axial position of said tube relative to said diaphragm.

7. The centrifuge according to claim 6, wherein said resilient means includes a helical compression spring which encircles said tube within said chamber and which has one end disposed against said fitting means and its other end disposed against a wall of said chamber.

8. The centrifuge according to claim 1, wherein said axis is approximately vertical; wherein said container has a bottom wall extending between lower edges of said cylindrical wall; wherein said container has an annular first baffle therein which is provided on and extends radially inwardly from said cylindrical wall, said first baffle dividing the radially outer portion of said container into two vertically spaced compartments; wherein said angularly spaced openings in said cylindrical wall are provided in the region of the lowermost of said compartments; and wherein said supply means introduces the mixture of the first and second liquids into the lowermost of said compartments.

9. The centrifuge according to claim 8, including a generally circular second baffle and means supporting said second baffle a small distance above said bottom wall of said container, a radially outer edge of said second baffle being spaced radially inwardly from said cylindrical wall of said container and being spaced radially outwardly of a radially inner edge of said first baffle; and wherein said supply means is adapted to introduce the mixture of the first and second liquids into the region between said second baffle and said bottom wall of said container.

10. The centrifuge according to claim 9, wherein said container includes a generally circular third baffle and means supporting said third baffle a small distance above said first baffle, said third baffle having a radially outer edge which is spaced radially inwardly from said cylindrical wall of said container and radially outwardly from said radially inner edge of said first baffle.

11. A centrifuge for separating first and second liquids from a mixture thereof, the specific gravity of the first liquid being greater than that of the second liquid, comprising: a container supported for rotation about an axis; drive means for effecting rotation of said container about said axis; supply means for introducing into said container during rotation thereof the mixture of the first and second liquids, rotation of said container causing the first liquid to move to a radially outermost portion of said container; valve means supported on said container and in fluid communication with said portion of said container and with a region external to said container, said valve means being responsive to fluid pressure in said portion of said container for discharging quantities of the first liquid from said portion of said container to said region external to said container during rotation of said container; and means for removing from said container during rotation thereof quantities of the second liquid which have been separated from the first liquid; wherein said container includes a cylindrical wall substantially concentric with said axis, said portion of said container being adjacent said wall and said wall having plural angularly spaced openings therethrough; wherein said valve means includes plural valves which are each supported on said cylindrical wall in the region of a respective said opening therein and which each control fluid flow through the associated opening; wherein said axis is approximately vertical; wherein said container has a generally horizontal bottom wall extending between lower edges of said cylindrical wall; wherein said container has a plurality of annular, vertically spaced first baffles therein which are each provided on and extend radially inwardly from said cylindrical wall, said first baffles dividing the radially outer portion of said container into a plurality of annular, vertically spaced compartments; wherein said cylindrical wall has means defining a plurality of said angularly spaced openings in the region of each said compartment and said valve means includes a said valve supported on said container in the region of each said opening for controlling fluid flow therethrough; and wherein said supply means introduces the mixture of said first and second liquids into the lowermost one of said compartments.

12. The centrifuge according to claim 11, wherein said plural openings in said cylindrical wall for each said compartment are angularly offset from said openings for each said compartment adjacent thereto.

13. The centrifuge according to claim 11, including an annular second baffle and means supporting said second baffle a small distance above said bottom wall of said container, a radially outer edge of said second baffle being spaced radially inwardly from said cylindrical wall of said container and being spaced radially outwardly of a radially inner edge of the lowermost of said first baffles; and wherein said supply means is adapted to introduce the mixture of the first and second liquids into the region between said bottom wall of said container and said second baffle.

14. The centrifuge according to claim 13, wherein said container includes an annular, platelike third baffle and means supporting said third baffle a small distance above the lowermost first baffle, said third baffle having a radially outer edge which is spaced radially inwardly from said cylindrical wall of said container and radially outwardly from the radially inner edge of the first baffle immediately thereabove, and said third baffle having a radially inner edge which is spaced radially inwardly from the radially inner edge of said lowermost first baffle.

15. The centrifuge according to claim 14, wherein each of said first baffles above the lowermost first baffle has a radially inner edge which is spaced radially outwardly from the radially inner edge of the first baffle immediately therebelow; wherein said supply means includes said container having a frustoconical wall which is supported on and converges upwardly from a radially inner edge of said second baffle and is concentric with said axis; and wherein said supply means includes a supply pipe which has an end located within the interior of an upper portion of said conical wall and is adapted to discharge the mixture of the first and second liquids into the region within said control wall.

16. The centrifuge according to claim 11, including a closed housing in which said container is rotatably supported, said housing having a first outlet opening in a bottom wall thereof and having means defining an annular, upwardly open catch tray therein which encircles said container in the region of an upper end of said cylindrical wall thereof, said means for removing said second liquid from said container including means defining an opening therein in the region of the top of said cylindrical wall, and said housing having means defining a second outlet opening in a lower portion of said catch tray.

17. The centrifuge according to claim 16, wherein said housing includes said bottom wall being upwardly concave, a cylindrical side wall extending upwardly from the outer edges of said bottom wall of said housing to a location spaced a small distance below the top of said cylindrical wall of said container, an annular cap which is supported on and extends radially inwardly from the top of said cylindrical side wall to a location adjacent said cylindrical wall of said container, an annular catch tray wall supported on and extending upwardly and outwardly from a location on said housing side wall spaced below the upper end thereof, said second outlet opening being provided through said catch tray wall at a location adjacent said housing side wall, and a downwardly concave top wall which has its peripheral edge supported on the peripheral edge of said catch tray wall.

18. The centrifuge according to claim 17, wherein said drive means includes a vertically extending shaft which is concentric with said axis and bearing means provided on said top and bottom walls of said housing for rotatably supporting said shaft, said shaft extending concentrically through said container and said container being fixedly supported thereon, said drive means including means for effecting rotation of said shaft.

19. A valve, comprising a valve housing having a bore therein which opens at one end through a first outer surface portion of said valve housing and opens at its other end into a chamber provided within said valve housing; a flexible diaphragm extending across said chamber approximately perpendicular to said bore and having its peripheral edges sealingly supported by said valve housing; an elongate tube slidably supported in said bore and extending through a central opening in said diaphragm; means for sealingly coupling said diaphragm and said tube so that movement of said diaphragm effects the axial movement of said tube; resilient means for yieldably urging axial movement of said tube in a direction toward said chamber; means defining a passageway in said valve housing which provides fluid communication between said first outer surface portion of said valve housing and a second outer surface portion thereof which is spaced from said first surface portion; means defining a valve seat at the end of said passageway which opens through said first surface portion of said valve housing; and a valve member which is fixedly supported on said tube and movable in response to axial movement of said tube between open and closed positions in which it is respectively spaced from and engaging said valve seat on said valve housing and respectively permits and obstructs fluid flow through said passageway in said valve housing.

20. The valve according to claim 19, wherein said valve housing includes an elongate stem portion which has said first and second outer surface portions of said valve housing at spaced locations thereon, said first outer surface portion being farther from said chamber in a direction parallel to said bore than said second outer surface portion, wherein said bore in said valve housing has an enlarged portion which extends from said first outer surface portion on said stem portion past said second outer surface portion, and including a discharge opening in said stem portion of said valve housing which provides fluid communication between said enlarged portion of said bore and said second outer surface portion, said enlarged portion of said bore and said discharge opening serving as said passageway through said valve housing and said valve seat and valve member being annular and encircling said tube.

21. The valve according to claim 20, wherein said valve housing includes an annular flange which extends into said enlarged portion of said bore adjacent and substantially parallel to said tube in a direction away from said chamber; wherein said valve member includes a fitting which is supported on and fixed against axial movement with respect to said tube and has at the axial end thereof nearest said chamber an annular recess which is adjacent said tube and into which said annular flange on said valve housing extends; wherein said valve seat on said valve housing is a frustoconical surface which converges in a direction toward said chamber; and wherein said valve member is an annular seal element which is fixedly supported on said fitting and has a frustoconical surface engageable with said valve seat.

22. The valve according to claim 21, wherein said valve housing has means defining a first vent opening which provides fluid communication between a location external to said valve housing and a portion of said chamber on a side of said diaphragm nearest said stem portion; and including means defining a vent line which is in fluid communication with said chamber in said valve housing on a side of said diaphragm remote from said stem portion.

23. The valve according to claim 22, including a plate which is disposed against said diaphragm on the side thereof facing said stem portion and which has a central opening aligned with said central opening in said diaphragm; wherein said means for sealingly coupling said tube and said diaphragm includes fitting means which extends through said aligned openings in and securely clamps together said diaphragm and said diaphragm plate, and which has an internally threaded central opening extending axially therethrough; and wherein said tube has an externally threaded portion which is received in said threaded opening through said fitting means, whereby rotation of said tube relative to said fitting means effects adjustment of the axial position of said tube relative to said diaphragm.

24. The valve according to claim 23, wherein said resilient means includes a helical compression spring which encircles said tube within said chamber and which has one end disposed against said fitting means and its other end disposed against a wall of said chamber.

* * * * *

UNITED STATES PATENT AND TRADEMARK OFFICE

CERTIFICATE OF CORRECTION

PATENT NO. : 4 543 083

DATED : September 24, 1985

INVENTOR(S) : Jerry O. Bounds

It is certified that error appears in the above-identified patent and that said Letters Patent is hereby corrected as shown below:

Column 11, line 46; change "control" to ---conical---.

Signed and Sealed this

*Sixth* Day of *May 1986*

[SEAL]

*Attest:*

DONALD J. QUIGG

*Attesting Officer*

*Commissioner of Patents and Trademarks*